US005724640A

United States Patent [19]

Thayer

[11] Patent Number: 5,724,640

[45] Date of Patent: Mar. 3, 1998

[54] FLOATING BACKER AND MOUNT FOR CLEANING BLADES AND SPOTS BLADES ON BELT IMAGING SURFACES

[75] Inventor: Bruce E. Thayer, Webster, N.Y.

[73] Assignee: Xerox Corporation, Stamford, Conn.

[21] Appl. No.: 786,545

[22] Filed: Jan. 21, 1997

[51] Int. Cl.[6] ..... G03G 21/00; G03G 15/00

[52] U.S. Cl. ..... 399/351; 15/1.51; 15/256.5; 399/164

[58] Field of Search ..... 399/164, 343, 399/351, 345, 99; 15/1.51, 256.5

[56] References Cited

U.S. PATENT DOCUMENTS

| | | | |
|---|---|---|---|
| 3,780,391 | 12/1973 | Leenhouts | 15/1.51 |
| 4,690,544 | 9/1987 | Forbes, II et al. | 399/164 |
| 5,243,385 | 9/1993 | Thayer | 399/164 |
| 5,319,431 | 6/1994 | Lindblad et al. | 399/164 |
| 5,323,218 | 6/1994 | Forbes, II et al. | 15/256.5 X |
| 5,519,480 | 5/1996 | Thayer | 399/355 |

*Primary Examiner*—A. T. Grimley
*Assistant Examiner*—Sophia S. Chen
*Attorney, Agent, or Firm*—T. L. Fair

[57] ABSTRACT

An apparatus for cleaning particles from a surface using a floating backer and cleaning or spots blade mounted to allow freedom to follow the location of the imaging surface. The cleaning or spots blade controls tolerances when the blade and the floating backer are mounted to a frame pivoted from a fixed photoreceptor backer. This freedom allows a minimization of the tolerances in blade load against the surface or photoreceptor, the blade angle to the photoreceptor and in the location of the blade relative to the backer. This floating backer and blade mount also minimizes the wrap required on the photoreceptor backers adjacent to the blade.

11 Claims, 3 Drawing Sheets

FLOATING BACKER AND MOUNT FOR CLEANING BLADES AND SPOTS BLADES ON BELT IMAGING SURFACES

BACKGROUND OF THE INVENTION

This invention relates generally to an electrostatographic printer and copier, and more particularly, to a cleaning apparatus for removing particles from an imaging surface.

Cleaning blades and spots blades require relatively small amounts of blade deflection for proper loading against the photoreceptor. This results in concerns over the tolerance build up which occurs through the blade mounting hardware, the machine frame, the belt module and finally to the location of belt photoreceptor backers on either side of the blade. In order to counter these tolerance stack ups, blades have, for instance, been loaded using weights designed to apply a consistent blade load as opposed to spring loaded or interference loaded blades. Spring loaded and interference loaded blades have been used primarily in CRUs (customer replaceable units) where the photoreceptor and blade cleaner are mounted in the same module and the tolerance stack up can be minimized. Even in the case of a weight loaded blade, however, the variation in blade tip angle to the photoreceptor cannot be properly controlled due to tolerance stack ups. An additional complication in the mounting of cleaning and spots blades is a limitation on the wrap angle of the photoreceptor backers.

The following disclosures may be relevant to various aspects of the present invention and may be briefly summarized as follows:

U.S. Pat. No. 5,243,385 to Thayer discloses an apparatus for increasing the cleaning efficiency of rigid blade cleaners used to clean compliant belt-type photoreceptors in low to high volume, black and white and color electrophotographic copiers and printers. A center portion of a backing photoreceptor support roll is proportionately bowed outward toward the cleaning blade to compensate for non-uniform belt tension under the blade cleaner due to the deflection of the backing support roll. In particular, the appropriate amount of bow in the center portion of a backing photoreceptor support roll or, alternatively, channel backer, results in a uniform cleaning blade load and, therefore, enhanced cleaning across a compliant belt photoreceptor having non-uniform belt tension, that is inexpensive and easy to manufacture and implement.

U.S. Pat. No. 5,519,480 to Thayer et al. discloses an apparatus and method for cleaning particles from a moving imaging surface. Backers are retracted from the photoreceptor to release cleaning contact between the brushes and the moving imaging surface during development of image-on-image in the multi-pass cycle. After transfer of the image, the backers move into contact with one side of the photoreceptor causing the moving imaging surface on the other side of the photoreceptor to contact the cleaner brushes. The brushes clean the moving imaging surface of the photoreceptor. The brushes are released from contact with the moving imaging surface when the backers are retracted, allowing the image on image multi-pass process to begin again. The brushes engage and disengage the photoreceptor in the interdocument zone (i.e. non-imaging region) of the moving surface.

SUMMARY OF THE INVENTION

Briefly stated, and in accordance with one aspect of the present invention, there is provided an apparatus for removing particles from a moving surface after transfer of an image therefrom, comprising: a device for removing particles from the surface, the removing device having two ends, a free end opposite a fixed end, the free end tangentially contacting the surface; a mount having a first end and a second end opposite the first end, the removing device having the fixed end coupled to the first end of the mount; a floating backer being attached to the second end of the mount oppositely adjacent the removing device, having the surface between the floating backer and the removing device; a frame having the mount attached thereto, the mount having the removing device and the floating backer coupled thereto; and a first fixed backer from which the frame having the removing device and the floating backer mounted thereon is pivoted.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 3:
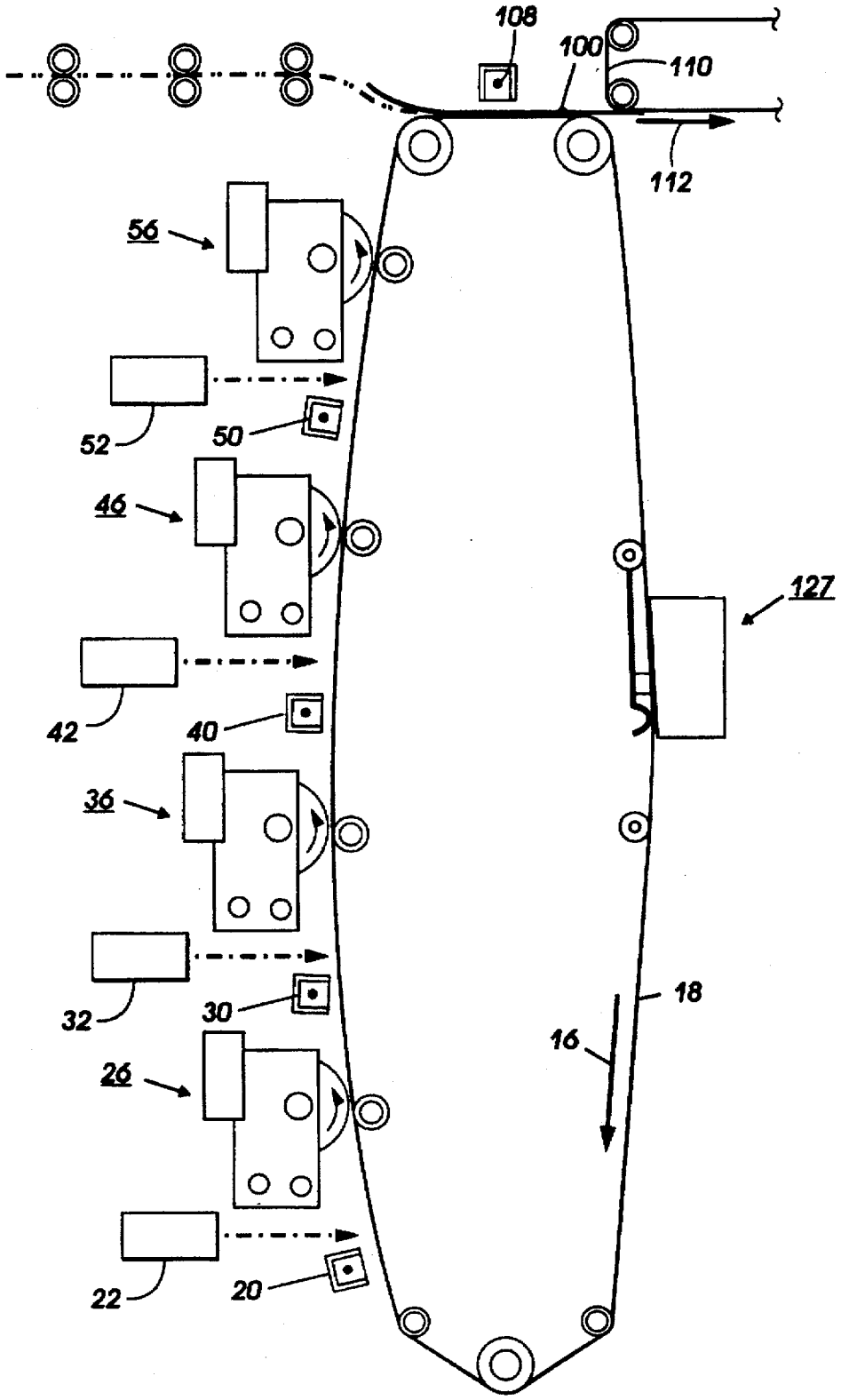
FIG. 3 is a schematic, elevational view of an electrostatographic printing machine incorporating the present invention.

For a general understanding of the features of the present invention, reference is made to the drawings, wherein like reference numerals have been used throughout to designate identical elements. FIG. 3 schematically illustrates a full-color, single-pass, image-on-image, electrostatographic printing machine incorporating the features of the present invention. It will become apparent from the following discussion that the apparatus of the present invention may be equally well-suited for use in a wide variety of printing processes and machine architectures such that the present invention is not necessarily limited in its application to the particular electrostatographic process or system described herein. Thus, although the present invention will be described in connection with a preferred embodiment thereof, it will be understood that the description of the invention is not intended to limit the invention to this preferred embodiment. Indeed, the description is intended to cover all alternatives, modifications, and equivalents as may be included within the spirit and scope of the invention as defined by the appended claims.

Turning now to FIG. 3, inasmuch as the art of electrostatographic printing is well known, the various processing will be described briefly with reference thereto. The multicolor electrostatographic printing machine employs a photoreceptor in the form of a continuous multi-layered belt member, generally comprising a photoconductive surface deposited on an electrically grounded conductive substrate. The photoreceptor 18 is entrained about a plurality of rollers, at least one of which is rotatably driven by a drive mechanism (not shown) for advancing the belt along a curvilinear path in the direction of arrow 16, such that successive portions of the photoreceptive belt 18 can be transported through the various processing stations disposed about the path of movement thereof.

The electrostatographic printing process is initiated by applying a substantially uniform charge potential to the photoreceptive member 18. As such, an initial processing station is shown as a charging station, including a corona generating device 20. The corona generating device 20 is capable of applying a relatively high and substantially uniform charge potential to the imaging surface of the photoreceptor belt 18.

After the substantially uniform charge is placed on the surface of the photoreceptor belt 18, the electrostatographic printing process proceeds by either imaging an input document placed on the surface of a transparent imaging platen (not shown), or by providing a computer generated image signal, for selectively discharging the photoconductive surface in accordance with the image to be generated. For multicolor printing and copying, the imaging process can involve separating the imaging information into the three primary colors plus black to provide a series of subtractive imaging signals, with each subtractive imaging signal being proportional to the intensity of the incident light of each of the primary colors or black. (It is noted that this system is also operable with less colors or additional colors.) These imaging signals are then transmitted to a series of individual raster output scanners (ROSs), shown schematically by reference numerals 22, 32, 42 and 52, for generating complementary color-separated latent images on the charged photoreceptive belt 18. Typically, each ROS 22, 32, 42, and 52 writes the latent image information in a pixel by pixel manner.

Each of these color-separated electrostatic latent images are serially developed into visible images on the photoreceptive belt 18. Development of each color-separated image occurs at the developer rolls identified in FIG. 3 by reference numerals 26, 36, 46, and 56.

Continuing with a general description of the multicolor electrostatographic printing process, belt 18 advances, in the direction of arrow 16. The photoreceptor belt 18 is charged by a corona device 20, initially, then the ROS 22 selectively dissipates the charge laid down by the corotron 20 to record the first color (e.g. cyan toner) separated electrostatic latent image corresponding to regions to be developed by the developer roll 26 occurs to place the first color toner on the belt 18 surface. The belt 18 continues to advance to the next exposure station where the ROS 32 selectively dissipates the charge laid down by corotron 30 to record another color toner separated electrostatic latent image corresponding to regions to be developed by the developer roll 36.

After the electrostatic latent image has been developed with (e.g. magenta) toner, the photoconductive surface of belt 18 continues to be advanced in the direction of arrow 16 to the next corona generating device 40, which, once again, recharges the photoconductive surface to a substantially uniform potential. Thereafter, ROS 42 selectively discharges this new charge potential on the photoconductive surface to record yet another color separated electrostatic latent image, which may be partially or totally superimposed on the prior cyan and magenta developed images, for development with yellow toner. In this manner, a yellow toner image is formed on the photoconductive surface of belt 18 in superimposed registration with the previously developed cyan and magenta images. It will be understood that the color of the toner particles at each development station may be provided in an arrangement and sequence that is different than described herein.

After the yellow toner has been formed on the photoconductive surface of belt 18, the belt 18 continues to advance to recharge station 50 and the corresponding ROS 52 for selectively discharging those portions of belt 18 which are to be developed with black toner. In this final development step, black images are developed via a process known as black under color removal process, wherein the developed image is located only on those portions of the photoconductive surface adapted to have black in the printed page and may not be superimposed over the prior cyan, magenta, and yellow developed images. A final developed image is obtained.

Using the process described hereinabove, a composite multicolor toner image is formed on the photoconductive surface of belt 18. It will be recognized that the present description is directed toward a REaD (Recharge, Expose and Develop) process, wherein the charged photoconductive surface of photoreceptive belt 18 is serially exposed to record a series of latent images thereon corresponding to the subtractive color of one of the colors of the appropriately colored toner particles at a corresponding development station. Thus, the photoconductive surface is continuously recharged and reexposed to record latent images thereon corresponding to the subtractive primary of another color of the original. This latent image is therefore serially developed with appropriately colored toner particles until all the different color toner layers are deposited in superimposed registration with one another on the photoconductive surface. It should be noted that either discharged area development (DAD), wherein discharged portions are developed, or charged area development (CAD), wherein charged areas are developed can be employed, as will be described.

After the composite multicolor image is formed on the photoreceptor, the multi-layer developed image may be further conditioned with corona and/or light and then advanced to a transfer station, whereat a sheet of support material 100, typically a sheet of paper or some similar sheet-like substrate, is guided into contact with the photoreceptor 18. At the transfer station, a corona generating device 108 directs ions onto the back side of the support material 100 for attracting the composite multicolor developed image on belt 18 to the support material 100. While direct transfer of the composite multicolor developed image to a sheet of paper has been described, one skilled in the art will appreciate that the developed image may be transferred to an intermediate member, such as a belt or drum, and then, subsequently, transferred and fused to the sheet of paper, as is well known in the art. After the image has been transferred to the support substrate, a conveyor belt 110 moves the sheet of paper in the direction of arrow 112 to a drying or fusing station. The cleaning station for the photoreceptor surface is indicated by reference numeral 127. This cleaning station is discussed in more detail in FIGS. 1 and 2.

Figure 1:
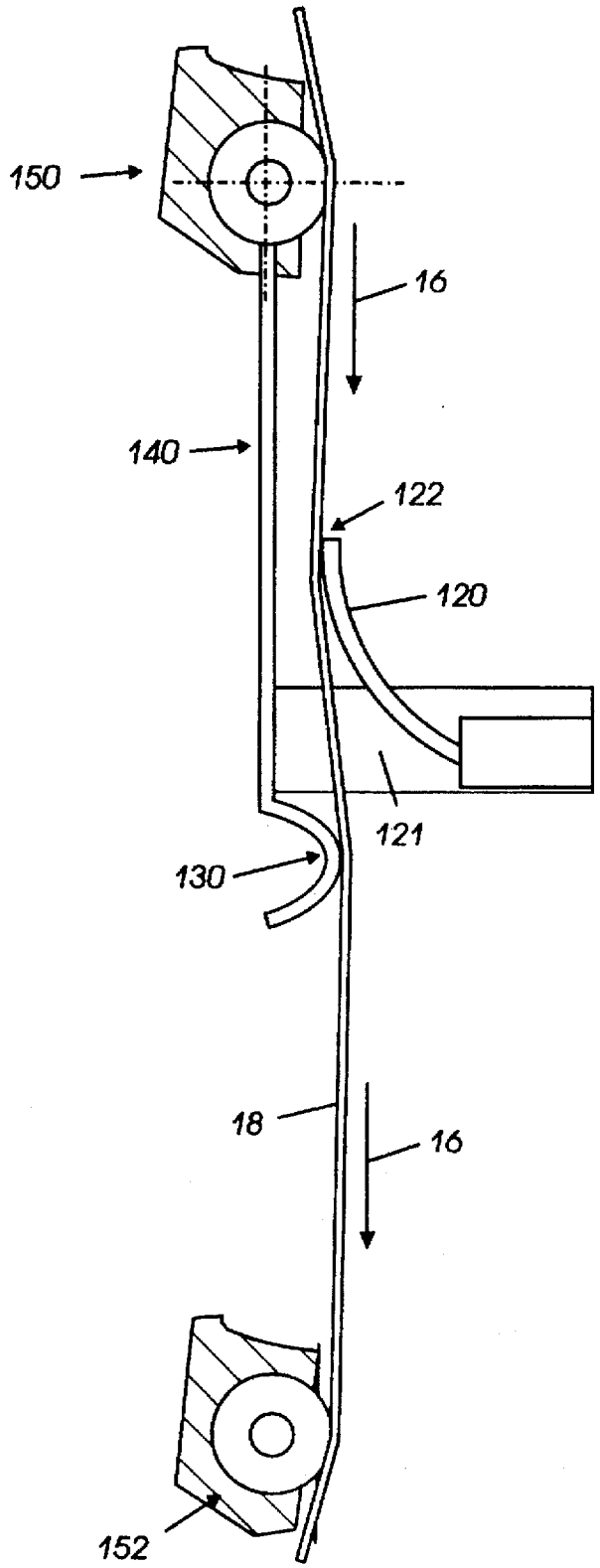
FIG. 1 is schematic elevational view of the present invention using a blade in a doctoring mode.

Reference is now made to FIG. 1, which shows a schematic elevational view of the present invention with a floating backer and a blade in the doctoring mode. The cleaning blade or spots blade 120 is coupled to opposite ends of the blade mount 121. The blade must be attached to a stiff blade holder which supports and straightens the blade over the full length of the blade, the blade holder is then attached to the blade mounts, 121, at the inboard (IB) and outboard (OB) ends of the photoreceptor belt. The photoreceptor backer 130 and cleaning or spots blade 120 are mounted to the pivot frame 140 pivoted from a fixed photoreceptor backer 150 to enable the backer 130 and the blade 120 to freely follow the location of the photoreceptor belt 18 between fixed backers 150, 152 on either side of the blade 120. This freedom minimizes the tolerances of the blade load against the photoreceptor 18, the tolerances of the blade angle to the photoreceptor 18, and the tolerances of the location of the blade 120 relative to the floating backer 130. This floating backer 130 and blade mount 121 also minimizes the wrap required on the photoreceptor backers 150, 152 adjacent to the blade 120.

With continued reference to FIG. 1, the wrap angle at fixed backer 152 is decreased slightly by the deflection of the photoreceptor 18 by the floating backer 130. However, the amount of wrap at fixed backer 150 is increased slightly by the deflection of the photoreceptor by the deflected blade. The spacing between the fixed backers 150, 152 is sufficient to provide enough space to fit a blade 120, 125 therebetween. The wrap on the fixed backers 150, 152 is determined by another backer before the first fixed backer 150 in the direction of motion of the photoreceptor and another backer after the second fixed backer 152. The amount of wrap is important in photoreceptor modules because each backer must have a minimum amount of wrap, while the drive roll must have as much wrap as possible keeping in mind that there is only 360 degrees of wrap available. The floating backer 130 allows good tolerance control for the blade interference without using any of the existing belt wrap because the change in wrap occurs between the two fixed backers and does not effect any of the other backers in the machine. An alternative configuration of the present invention includes a wiper blade 125 (see FIG. 2) or doctor blade 120, the floating backer upstream or downstream of the blade and any orientation of the assemblies with respect to gravity. Counterbalancing of the pivot frame 140 with the blade 120, 125 and damping may be required to prevent oscillations of the assembly and undue photoreceptor deflection.

Figure 2:
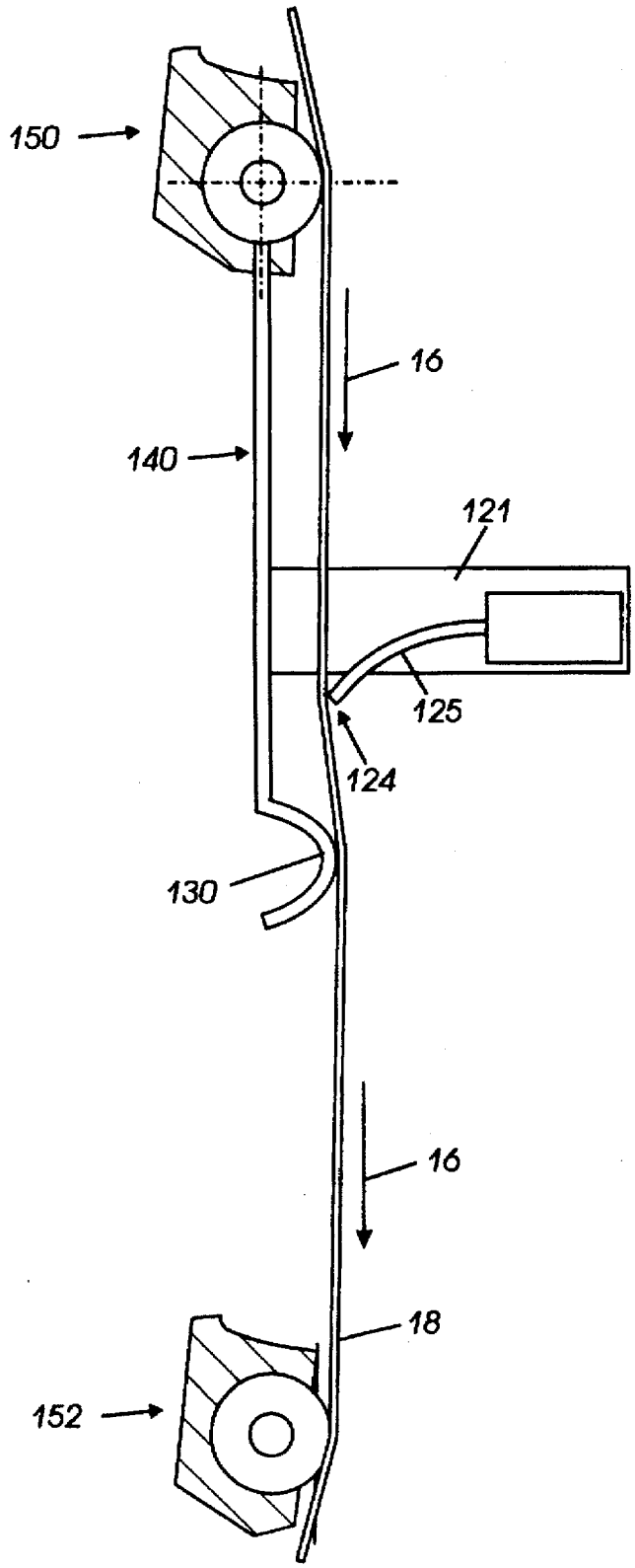
FIG. 2 is a schematic elevational view of the present invention using a blade in a wiping mode.

Further reference is made to FIGS. 1 and 2. In the present invention, loading of the blade 120, 125 is determined by the interference of the blade to the photoreceptor. (The blade can be flexible as well as totally rigid in the present invention.) The undeflected photoreceptor location is controlled by fixed backer 150 and floating backer 130. The interference of the blade to the photoreceptor is controlled by the undeflected position of the blade tip 122, 124 relative to the undeflected photoreceptor location. All three of these controlling points are located relative to the rigid pivoting frame 140, which minimizes variations in blade load and angle due to tolerances. The blade 120, 125 is located relative to the photoreceptor exactly the same as a blade not using the floating backer 130. The purpose of the present invention is to eliminate tolerances which occur in standard blade mounting schemes. Applying the floating backer of the present invention to a cleaning blade reduces the variability in the critical parameters which determine good cleaning. The present invention incorporates two fixed backers where the blade and floating backer pivot together about the single fixed backer and some tolerances are eliminated. (An example of the present invention would be a tip angle to the photoreceptor of about 15 degrees and a blade load of about 35 g/cm.)

The floating backer and the pivoting frame of the present invention are made from materials such as thermoplastics or metals including steel and aluminum. Likewise, the blade mount of the present invention is made from materials such as thermoplastics or metals including steel and aluminum.

The advantages of the blade mounting of the present invention over existing methods include: low cost interference mounting of the blade resulting from proper control of location tolerances relative to the photoreceptor position; proper locational control of the blade position relative to the photoreceptor due to the pivoting frame mounted to a fixed backer center (frame pivots can be introduced in other locations with some loss of tolerance control); minimization of the amount of wrap around the fixed backers due to the floating backer and blade following the position of the photoreceptor; improvement in the photoreceptor drag variability due to better control over the blade deflection tolerance and blade load; simple blade replacement is enabled through mounting a removable rigid blade holder to inboard and outboard location features on the pivot frame; blade mounting method applies to all orientations of blade location relative to gravity; and the blade mounting of the present invention is applicable to both cleaning blades and spots blades.

In recapitulation, the present invention utilizes mounting of the cleaning or spots blade to control tolerances. The blade and the two backers are tied together by a frame pivoting off of one fixed backer. Since all three points are tied together by the pivoting frame, the tolerances between the three points are reduced and better blade critical parameter results are achieved. The positioning of the blade is controlled by mounting the blade to a pivot frame located on a floating backer behind the photoreceptor belt that is pivoting off of a fixed backer.

It is, therefore, apparent that there has been provided in accordance with the present invention, a floating backer and mount for cleaning and spots blades on belt photoreceptors that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing particles from a moving surface after transfer of an image therefrom, comprising:

a device for removing particles from the surface, said removing device having two ends, a free end opposite a fixed end, said free end tangentially contacting the surface;

a mount having a first end and a second end opposite said first end, said removing device having the fixed end coupled to said first end of said mount;

a floating backer being attached to said second end of said mount oppositely adjacent said removing device, having the surface between said floating backer and said removing device;

a frame having said mount attached thereto, said mount having said removing device and said floating backer coupled thereto; and a first fixed backer from which said frame having said removing device and said floating backer mounted thereon is pivoted.

2. An apparatus as recited in claim 1, wherein said removing device comprises a blade.

3. An apparatus as recited in claim 2, wherein said blade comprises a cleaning blade.

4. An apparatus as recited in claim 2, wherein said blade comprises a spots blade.

5. An apparatus as recited in claim 2, further comprising a second fixed backer located downstream from said first fixed backer, in the direction of motion of the surface.

6. An apparatus as recited in claim 5, wherein said frame enabling pivoting being substantially rigid.

7. An apparatus as recited in claim 6, wherein the substantially rigid frame for pivoting minimizes load variations on said blade.

8. An apparatus as recited in claim 7, wherein said floating backer, said first fixed backer and said second fixed backer are located on an opposite side of the surface from said blade.

9. An apparatus as recited in claim 8, wherein the second end of said blade having a tip, contacts the surface with said tip to remove particles therefrom.

10. An apparatus as recited in claim 9, wherein said blade being capable of deflection.

11. An apparatus as recited in claim 10, wherein said pivoting frame having said floating backer and said blade and the first fixed backer coupled thereon, minimizes variations in load and angle of said blade due to tolerances.

* * * * *